US009373239B2

(12) United States Patent
Ebe

(10) Patent No.: US 9,373,239 B2
(45) Date of Patent: Jun. 21, 2016

(54) IN-VEHICLE PRESCRIPTION AND MEDICAL REMINDERS

(71) Applicant: Toyota Motor Engineering & Manufacturing North America, Inc., Erlanger, KY (US)

(72) Inventor: Kazutoshi Ebe, Novi, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 28 days.

(21) Appl. No.: 14/333,615

(22) Filed: Jul. 17, 2014

(65) Prior Publication Data

US 2016/0019767 A1 Jan. 21, 2016

(51) Int. Cl.
*G08B 21/02* (2006.01)
*G08B 21/18* (2006.01)

(52) U.S. Cl.
CPC ..... *G08B 21/02* (2013.01); *G08B 21/18* (2013.01)

(58) Field of Classification Search
CPC ..... G08B 21/02
USPC ..... 340/425.5, 309.16, 309.7, 573.1; 368/10; 221/2; 206/534
See application file for complete search history.

(56) References Cited

U.S. PATENT DOCUMENTS

| | | | | |
|---|---|---|---|---|
| 5,377,258 | A | 12/1994 | Bro et al. | |
| 5,684,455 | A | 11/1997 | Williams et al. | |
| 5,689,241 | A | 11/1997 | Clarke, Sr. et al. | |
| 5,872,505 | A | 2/1999 | Wicks et al. | |
| 6,822,573 | B2 | 11/2004 | Basir et al. | |
| 7,902,987 | B2 | 3/2011 | Lemasson et al. | |
| 2001/0009398 | A1 * | 7/2001 | Sekura | A61J 7/0481 340/573.1 |
| 2003/0191375 | A1 * | 10/2003 | Anker | G08B 21/24 600/300 |
| 2011/0193708 | A1 * | 8/2011 | Comeau | B60K 28/063 340/576 |
| 2012/0214436 | A1 | 8/2012 | Clark et al. | |
| 2012/0319856 | A1 * | 12/2012 | Johnson | G08B 21/24 340/669 |

* cited by examiner

*Primary Examiner* — Jeffery Hofsass
(74) *Attorney, Agent, or Firm* — Christopher G. Darrow; Darrow Mustafa PC

(57) ABSTRACT

A computing device, methods, and systems for providing in-vehicle prescription and medical reminders are disclosed. One example method for providing in-vehicle prescription and medical reminders includes identifying a vehicle occupant; determining, based on medical information associated with the occupant, whether a medical activity is due to be performed; and alerting the occupant if a medical activity is due to be performed. An example medical activity includes administering prescription medication. Example implementations include identifying the occupant based at least in part on biometric data; alerting the occupant by a visual, audible, or haptic alert; prompting the occupant to provide a response acknowledging the alert; and notifying designated third parties. The medical information can be received from an online profile or obtained through vital-sign sensors.

23 Claims, 3 Drawing Sheets

IN-VEHICLE PRESCRIPTION AND MEDICAL REMINDERS

BACKGROUND

The present disclosure relates to a vehicle and more particularly to devices, systems, and methods for driver reminders regarding prescription drug reminders.

The number of elderly drivers has continued to increase in recent years. According to a statistic released by the U.S. Department of Transportation in 2000, the number of drivers aged 70 years and over holding a valid license in the United States more than doubled, from 8.8 million to 18.9 million. In 2004, the U.S. Department of Transportation reported that 10% of all drivers on the road were aged 70 years and over.

Drivers who take prescription medication, and particularly older drivers, may have a difficult time remembering to take their prescribed medication. There have been standalone devices designed to monitor patients' medication regimens—as disclosed, for example, in U.S. Pat. No. 5,872,505 to Wicks, et al.—however, patients may not always be carrying such devices. In addition, the devices do not provide transportation that may be necessary for the patient to obtain the required medication.

SUMMARY

Disclosed herein are devices, systems, and methods for providing in-vehicle prescription and medical reminders. In one example implementation, biometric sensors are used to identify a vehicle occupant such as a driver. In another example implementation, reminders are presented to the driver via visual, audible, and/or haptic alerts.

One example computing device for providing in-vehicle prescription and medical reminders includes one or more processors for controlling the operations of the computing device and a memory for storing data and program instructions used by the one or more processors, wherein the one or more processors are configured to execute instructions stored in the memory to: identify a vehicle occupant; determine, based on medical information associated with the occupant, whether a medical activity is due to be performed; and alert the occupant if a medical activity is due to be performed One example method for providing in-vehicle prescription and medical reminders includes identifying a vehicle occupant; determining, based on medical information associated with the occupant, whether a medical activity is due to be performed; and alerting the occupant if a medical activity is due to be performed.

One example system for providing in-vehicle prescription and medical reminders includes one or more biometric sensors associated with a vehicle; a computing device in communication with the one or more biometric sensors, the computing device comprising one or more processors for controlling the operations of the computing device and a memory for storing data and program instructions used by the one or more processors, wherein the one or more processors are configured to execute instructions stored in the memory to: identify a vehicle occupant based at least in part on biometric data received from the one or more biometric sensors; determine, based on medical information associated with the occupant, whether a medical activity is due to be performed; and alert the occupant if a medical activity is due to be performed.

BRIEF DESCRIPTION OF THE DRAWINGS

The description herein makes reference to the accompanying drawings wherein like reference numerals refer to like parts throughout the several views, and wherein.

DETAILED DESCRIPTION

Disclosed herein are devices, systems, and methods for providing in-vehicle prescription and medical reminders. Biometric sensors can be used to identify a vehicle occupant such as a driver. Driver profiles, stored in on-board memory or remotely in cloud storage, can contain medical information of the driver, including prescription schedules and dosing information. Once a driver is identified, reminders can be presented to the driver via visual, audible, and/or haptic alerts. The driver can also be prompted to affirmatively acknowledge receipt of the alerts. If the driver does not so acknowledge, access to one or more vehicle functions can be denied. Notifications can also be provided to designated third parties, who may be other vehicle passengers or remote parties.

Figure 1:
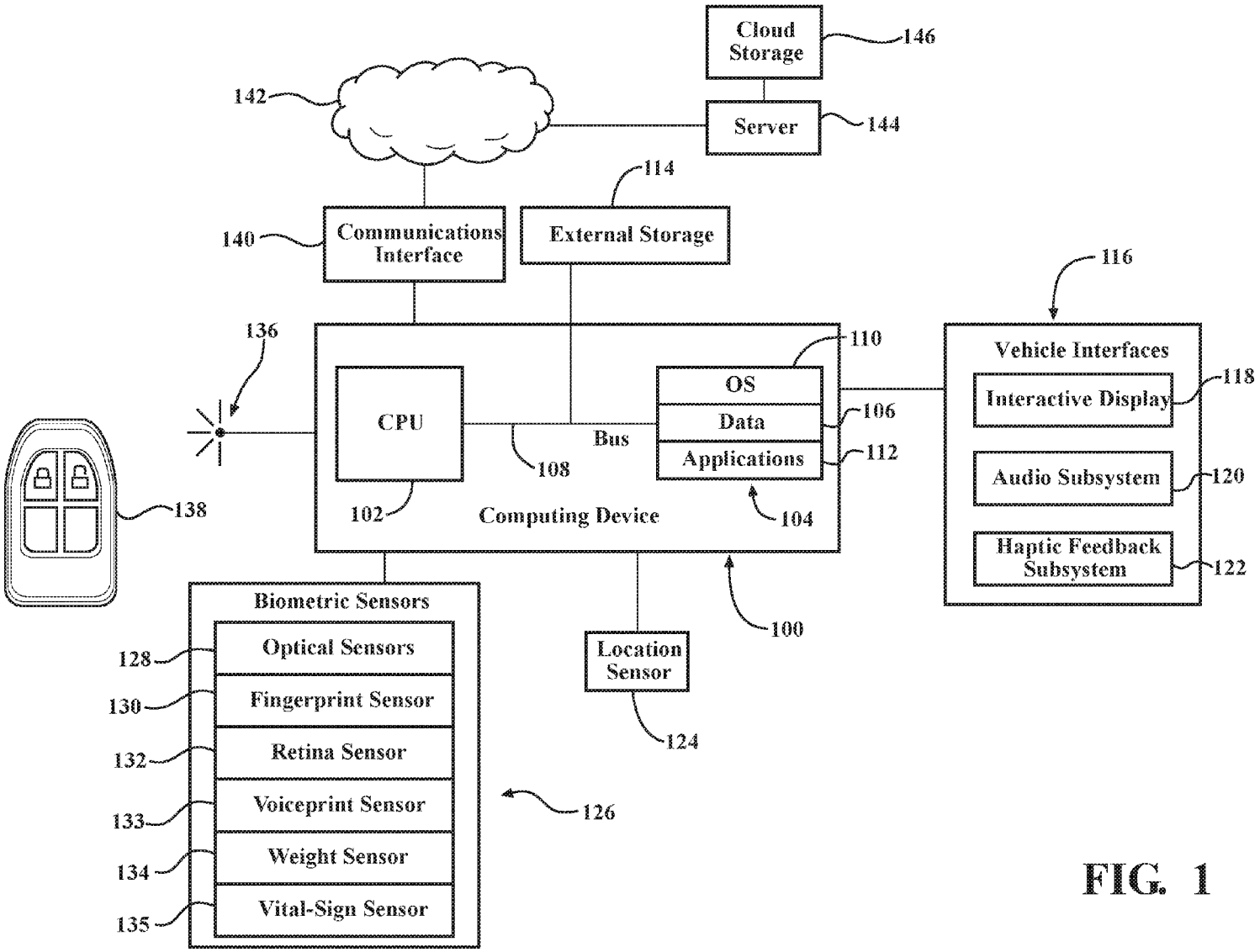
FIG. 1 is a schematic block diagram of a computing device for providing in-vehicle prescription and medical-reminders.

FIG. 1 is a schematic block diagram of a computing device 100 for providing in-vehicle prescription and medical reminders. The computing device 100 can be any type of vehicle-installed, handheld, desktop, or other form of single computing device, or can be composed of multiple computing devices. A processing unit 102 in the computing device can be a conventional central processing unit (CPU) or any other type of device, or multiple devices, capable of manipulating or processing information. A memory 104 in the computing device can be a random access memory device (RAM) or any other suitable type of storage device. The memory 104 can include data 106 that is accessed by the CPU 102 using a bus 108.

The memory 104 can also include an operating system 110 and installed applications 112, the installed applications 112 including programs that permit the CPU 102 to implement the in-vehicle prescription and medical reminders, as described below. The computing device 100 can also include secondary, additional, or external storage 114, for example, a memory card, flash drive, or any other form of computer readable medium, including on a user's external mobile device. In one implementation, the installed applications 112 can be stored in whole or in part in the external storage 114 and loaded into the memory 104 as needed for processing.

The computing device 100 can be in direct or indirect communication with one or more vehicle interfaces 116 through which the driver can receive notifications and send commands to the computing device 100. Example vehicle interfaces 116 can include an interactive display 118, an audio subsystem 120 (which can include, for example, speakers and/or microphones), and a haptic feedback subsystem 122. The computing device 100 can be in direct or indirect communication with various sensors, such as location sensors 124 that can receive location information through the Global Positioning System (GPS), and biometric sensors 126 used to identify and authenticate the driver or other vehicle occupants. Examples of biometric sensors 126 can include optical sensors 128 (such as cameras), fingerprint sensors 130, retina sensors 132, voiceprint sensors 133, and weight sensors 134. The biometric sensors 126 can capture biometric data, which can be sent to the computing device 100 through the bus 108 or can be stored in memory 104 or external storage 114 for later retrieval by the computing device 100.

The computing device 100 can be in direct or indirect communication with a wireless transmitter/receiver 136 with which the computing device 100 can communicate with a wireless key fob 138 carried by the driver. The computing device 100 can also include a communications interface 140 with which the computing device 100 can communicate with external sources through a network 142, such as the internet. These external sources can include remote servers 144, which can connect the computing device 100 to cloud storage 146. The computing device 100 can also use the cloud storage 146 as the external storage 114.

Figure 2:
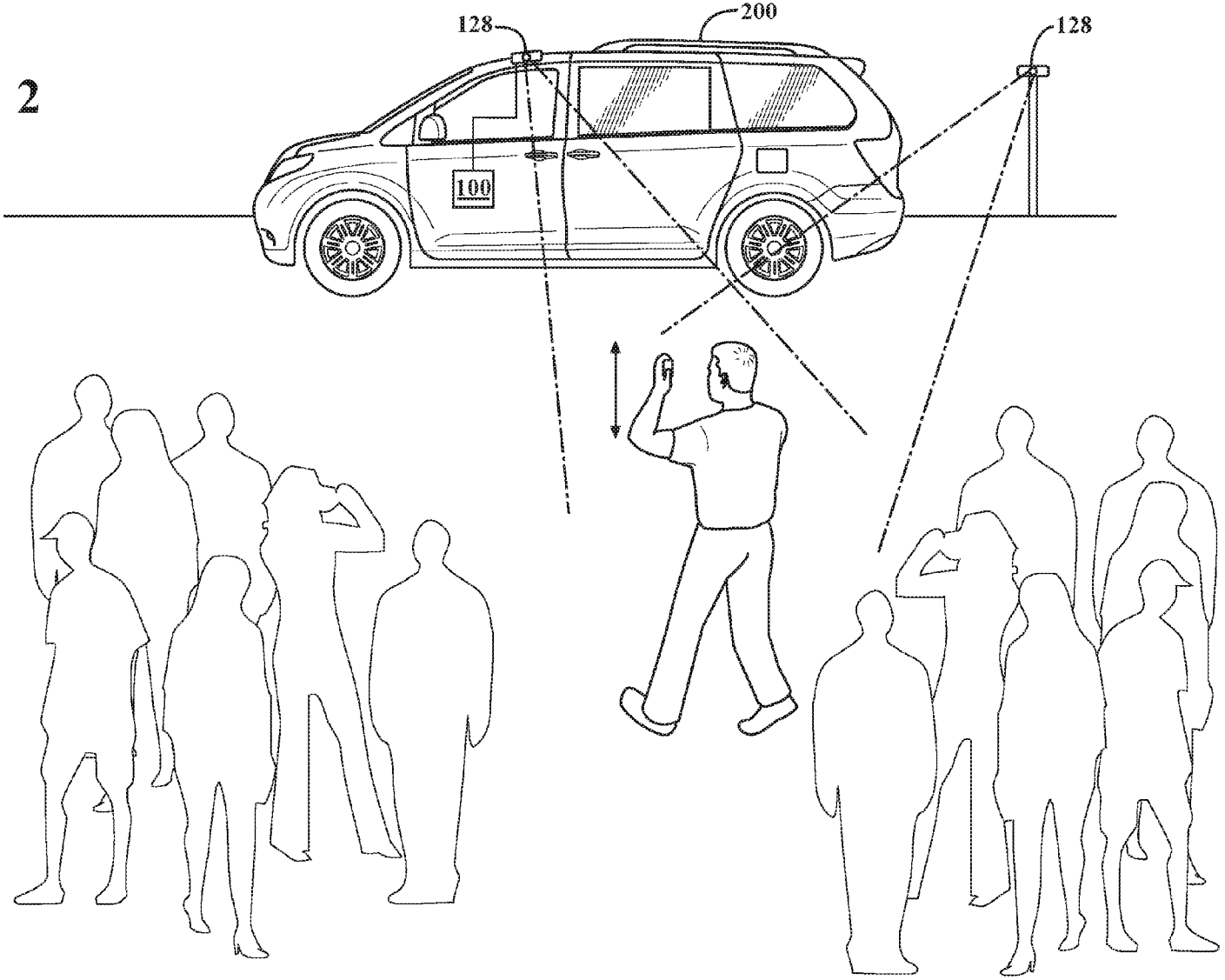
FIG. 2 is a pictorial representation of a vehicle including the computing device of FIG. 1.

FIG. 2 is a pictorial representation of a vehicle 200 in direct or indirect communication with the computing device 100. The computing device 100 can be located within the vehicle 200 or can be located remotely from the vehicle 200 in an alternate location. If the computing device 100 is remote from the vehicle, the vehicle 200 can include the capability of communicating with the computing device 100, such as through the communications interface 140.

In accordance with one example implementation, a user can be identified and authenticated using the computing device 100. In accordance with one example implementation, the user can be the driver of the vehicle 200 or another vehicle occupant or passenger. (Because the disclosed implementations may be employed with respect to any one or more persons in the vehicle 200 without departing from the spirit or scope of the invention, whether such person is the driver or another vehicle occupant, the terms "user," "driver," and "occupant" are used interchangeably within this application.) The computing device 100 can identify and authenticate the driver with reference to the driver's biometric data.

As shown in FIG. 2, one or more optical sensors 128 associated with the vehicle can detect a person approaching the vehicle 200. Movement in the frame can signal that there is a person requiring identification, and known image pattern recognition techniques can be used to detect the presence of a person to be identified (as opposed to another vehicle or an animal, etc.). The optical sensors 128 may be located on the vehicle 200 or off the vehicle 200. As an example of an off-vehicle optical sensor 128, the optical sensor 128 can be located in a parking lot in which the vehicle 200 is parked and can transmit image or video data to the computing device 100, such as through the communications interface 140. In any case, the computing device 100 can identify the driver by the driver's unique biometric identifiers based on image or video data received from the optical sensors 128.

Figure 3:
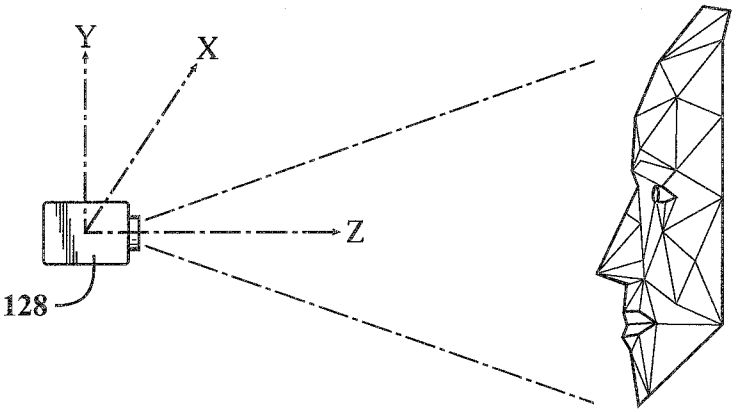
FIG. 3 is a pictorial representation of a driver facial map for use with driver identification and authentication.

One example of a biometric identifier that can be used to identify a driver is illustrated in FIG. 3, which shows an example facial map of person that can be captured by the optical sensors 128. Distance between the eyes, face shape, and other features can be used to uniquely identify an individual, or any other biometric marker can be used as well. Other example biometric identifiers include the person approaching the vehicle's 200 height, and the unique movement or gait of the person, each of which can be captured in images or video by the optical sensors 128 and processed by the computing device 100.

In another example implementation, one or more optical sensors 128 may be located in the interior of the vehicle. Accordingly, the identification can be implemented when the driver gets into the vehicle 200 or sits down or turns on the vehicle 200, rather than on approach to the vehicle 200.

Other biometric sensors 126 that are not shown but can be employed include fingerprint sensors 130, which can be located on the exterior of the vehicle 200, such as on the door handle, or in the interior of the vehicle 200, such as on the dashboard, console, or steering wheel; retina sensors 132; voiceprint sensors 133; weight sensors 134 built into the vehicle's 200 seats to identify and authenticate a driver based on the driver's known weight (with some variance allowed for different weights of clothing that the driver may be wearing or items that the driver may be carrying); or any other type of biometric sensor 126.

In an alternative example embodiment, the driver may be identified and authenticated by a unique signal received from the driver's key fob 138 or other electronic device carried by or otherwise associated with the driver (for example, the unique signal can be programmed into the driver's mobile phone). For additional security, both key fob identification and biometric identification may be employed in identifying and authenticating the driver.

Driver information may be stored in a driver profile, stored in the vehicle 200 (such as in memory 104), or in external storage 114, or remotely, such as in cloud storage 146. The driver profile can include the driver's prescription medication information, including dosage information and dosing schedules. The driver profile can also include other information, such as emergency medical contacts (who may be the driver's doctor and/or close family members). Multiple driver profiles may be stored, each profile associated with the particular driver's identification information (e.g., biometric information, key fob 138 identity, etc.).

In one example implementation, if the driver has a medical activity due, the driver can be alerted via a visual, audible, or haptic reminder. The medical activity can be considered "due" if it is scheduled to be performed at any near time (such as within a specified time period before or after the inquiry). In one example implementation, the medical activity is a scheduled medication dose. Alternatively, a reminder can be provided to the driver with respect to any medical activity the driver is supposed to undertake, and the disclosures herein are not limited to taking pills. For example, in one implementation, the driver can be reminded to self-administer an insulin shot, or to change a bandage or cast. In addition, the driver can be reminded to report to a medical professional to have a scheduled activity or procedure performed, whether a recurring procedure or a one-time procedure. For example, the driver could be reminded to report to a dialysis center for dialysis treatment or to a primary care physician for a routine physical.

In one example implementation, the reminder can appear on the interactive display 118 informing the driver of the medication to be taken, the dose, and the time it should be taken. To prevent the driver from inadvertently confusing the current dose with other prescribed medication, the interactive display 118 can also optionally display an image of the pill to be taken, or describe the appearance of the pill and/or container (e.g., "red oblong pill in blue bottle"), as such information may be available from on-board or remote databases.

In another example implementation, the audio subsystem 120 can deliver an audible reminder informing the driver of the medication to be taken, the dose, and the time it should be taken. In addition, the haptic feedback subsystem 120 can activate a vibration in the driver's seat or steering wheel, for example, to alert the driver to an important message.

If the time to take the medication is in the past, the visual or audible alert can be more distinctive, warning the driver that the medication must be taken right away to avoid being later than it already is. For example, a visual reminder could be presented in a different color or flashing, or an audible reminder could be louder or include an extra sound or chime. In any case, the driver may find it helpful to be reminded about the medication at the time the driver is entering into the vehicle 200, as the driver may need the vehicle 200 to travel to another location to obtain the existing medication or to fill a new prescription.

In one example implementation, the driver can be required to provide a response to affirmatively acknowledge receipt of the alert before proceeding to access vehicle functions. For example, the interactive display 118 can prompt the driver with an "Okay" button that the driver must press before other vehicle functions (such as the, radio, navigation system, etc.) will be available on the interactive display 118. As another example, the driver can speak an indication of acknowledgement that can be received by a voice recognition system associated with the vehicle 200. In one example implementation, the vehicle 200 can be prevented from driving (e.g., the gear would not be able to be engaged) unless the driver acknowledges the alert.

In one example implementation, biometric sensors 126 can also be used to determine whether a reminder should be presented to the driver, in addition to identifying the driver. Specifically, vital-sign sensors 135 can be used as biometric sensors 126 (or in addition to the biometric sensors 126 described above). For example, a blood sugar sensor can detect the driver's blood sugar level, and if the blood sugar level is too low or high compared with the driver's normal level as stored in the driver profile, then the driver can be reminded to take a medication for diabetes or an insulin shot, as appropriate. As another example, a blood pressure monitor sensor can detect the driver's blood pressure, and if the value is high compared with a predefined threshold stored in the driver profile, then the driver can be reminded to take a medication for hypertension. In one example implementation, the driver can be required to take a reading from such vital-sign sensors 135 before proceeding to access vehicle functions. In all of the above examples, the options whether to require such readings or acknowledgements can be set in the driver profile.

There may be other individuals, such as family members or medical professionals, who are responsible for the driver's wellbeing. These authorized third parties may be other passengers in the car or may be located elsewhere. In one example implementation, the computing device 100 can send an alert notification to authorized third parties about the driver's scheduled dose at the same time the driver is reminded. This can be accomplished, for example, with a voice message, text message, or email sent to the authorized third party's mobile device or email address. The computing device 100 can cause a notification to a remote third party through the communications interface 140, or using the driver's mobile phone (such as through a Bluetooth connection). In another example implementation, a notification is sent to an authorized third party only if the driver fails to acknowledge the alert (in one of the manners described above). In either case, a notification to the authorized third parties can include location information received from the location sensor 124.

Figure 4:
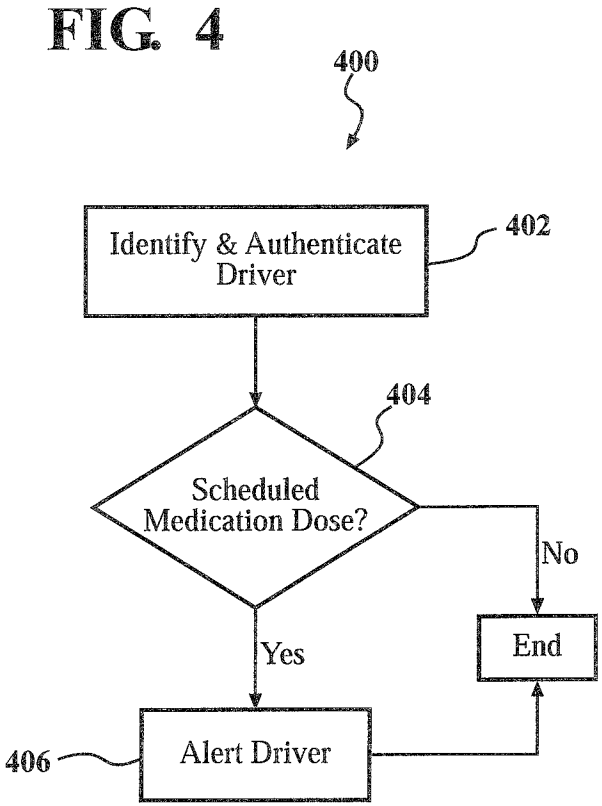
FIG. 4 is a logic flowchart of an example process for providing in-vehicle prescription and medical-reminders.

FIG. 4 is an example logic flowchart of a process 400 for providing in-vehicle prescription and medical reminders. In step 402, the driver is identified and authenticated. This can be done, for example, using the biometric sensors 126, as described above. In step 404, the computing device 100 determines whether there is a scheduled medication dose about which the driver needs to be alerted. This can be done with reference to the driver's profile, as described above. If there is no dose scheduled near in time (either past, present, or future), then the process ends. If there is a dose scheduled, then, in step 406, the driver is alerted. In addition, at this step, the driver can be prompted to acknowledge receipt of the alert and/or authorized third parties can be alerted as well, each as described above. Then, the process ends.

The foregoing description relates to what are presently considered to be the most practical embodiments. It is to be understood, however, that the disclosure is not to be limited to these embodiments but, on the contrary, is intended to cover various modifications and equivalent arrangements included within the spirit and scope of the appended claims. For example, in the embodiments described above, the vehicle 200 is generally described an automobile. However, the vehicle 200 is not limited to an automobile, as the disclosed systems and methods could also be implemented with other vehicles generally controlled by a driver, or operator, such as airplanes, boats, trains, etc. The scope of the claims is thus to be accorded the broadest interpretation so as to encompass all such modifications and equivalent structures as is permitted under the law.

What is claimed is:

1. An in-vehicle reminder system, comprising:

a vehicle-installed interface;

a computing device in communication with the interface, the computing device comprising one or more processors for controlling the operations of the computing device and a memory for storing data and program instructions used by the one or more processors, wherein the one or more processors are configured to execute instructions stored in the memory to:

uniquely identify a vehicle occupant;

access, based on the occupant's identity, medical information associated with the occupant;

determine, based on the medical information associated with the occupant, whether a medical activity is due to be performed; and operate the interface to alert the occupant if a medical activity is due to be performed.

2. The system of claim 1, further comprising:

one or more biometric sensors in communication with the computing device, the one or more biometric sensors operable to generate biometric data about people in or approaching a vehicle, wherein the occupant is uniquely identified based at least in part on biometric data received from the one or more biometric sensors.

3. The system of claim 1, wherein the occupant is uniquely identified based at least in part on visual recognition of the occupant.

4. The system of claim 1, wherein the occupant is uniquely identified based at least in part on a unique signal received from an electronic device associated with the occupant.

5. The system of claim 1, wherein the medical information associated with the occupant is accessed from a remote location.

6. The system of claim 1, wherein the medical activity involves administering prescription medication, and wherein the medical information includes scheduling and dosage information regarding the prescription medication.

7. The system of claim 1, wherein the occupant is alerted by at least one of a visual, audible, or haptic alert.

8. The system of claim 1, wherein the one or more processors are further configured to execute instructions stored in the memory to operate the interface to prompt the occupant for a response to the alert.

9. The system of claim 1, wherein the one or more processors are further configured to execute instructions stored in the memory to notify designated third parties if a medical activity is due to be performed.

10. A computer-implemented method for in-vehicle reminders, comprising:

with a computing device:

uniquely identifying a vehicle occupant, accessing, based on the occupant's identity, medical information associated with the occupant, and determining, based on the medical information associated with the occupant, whether a medical activity is due to be performed; and operating a vehicle-installed interface to alert the occupant if a medical activity is due to be performed.

11. The method of claim 10, wherein the occupant is uniquely identified based at least in part on biometric data about people in or approaching the vehicle received from one or more biometric sensors.

12. The method of claim 10, wherein the occupant is uniquely identified based at least in part on a unique signal received from an electronic device associated with the occupant.

13. The method of claim 10, wherein the medical information associated with the occupant is accessed from a remote location.

14. The method of claim 10, wherein the medical activity involves administering prescription medication, and wherein the medical information includes scheduling and dosage information regarding the prescription medication.

15. The method of claim 10, wherein the occupant is alerted by at least one of a visual, audible, or haptic alert.

16. The method of claim 10, further comprising:

prompting the occupant for a response to the alert, and wherein access to one or more vehicle functions is denied until the occupant provides the response.

17. The method of claim 10, wherein the one or more processors are further configured to notify designated third parties if a medical activity is due to be performed.

18. The system of claim 2, wherein at least one of the one or more biometric sensors is installed off-board the vehicle and operable to generate biometric data about people approaching the vehicle, and wherein the occupant is uniquely identified based at least in part on biometric data generated by the at least one biometric sensor as the occupant approaches the vehicle.

19. The system of claim 2, wherein uniquely identifying the vehicle occupant includes identifying one of a plurality of profiles that have identification information and medical information associated with respective persons as the occupant's profile by matching the biometric data received from the one or more biometric sensors to the identification information in the occupant's profile, with the medical information in the occupant's profile being accessed as the medical information associated with the occupant.

20. The system of claim 1, wherein uniquely identifying the vehicle occupant includes identifying one of a plurality of profiles that have medical information associated with respective persons as the occupant's profile, with the medical information in the occupant's profile being accessed as the medical information associated with the occupant.

21. The method of claim 11, wherein at least one of the one or more biometric sensors is installed off-board the vehicle and operable to generate biometric data about people approaching the vehicle, and wherein the occupant is uniquely identified based at least in part on biometric data generated by the at least one biometric sensor as the occupant approaches the vehicle.

22. The method of claim 11, wherein uniquely identifying the vehicle occupant includes identifying one of a plurality of profiles that have identification information and medical information associated with respective persons as the occupant's profile by matching the biometric data received from the one or more biometric sensors to the identification information in the occupant's profile, with the medical information in the occupant's profile being accessed as the medical information associated with the occupant.

23. The method of claim 10, wherein uniquely identifying the vehicle occupant includes identifying one of a plurality of profiles that have medical information associated with respective persons as the occupant's profile, with the medical information in the occupant's profile being accessed as the medical information associated with the occupant.

* * * * *